United States Patent [19]

Beakley et al.

[11] Patent Number: 4,971,017

[45] Date of Patent: Nov. 20, 1990

[54] ARRANGEMENT FOR SUPPLYING FUEL FROM A SUPPLY TANK TO INTERNAL COMBUSTION ENGINE OF POWER VEHICLE

[75] Inventors: James Beakley, LiVonia; Howard Turek, Novi; Willi Strohl, Farmington Hills; Jaihind S. Sumal, Bloomfield, all of Mich.

[73] Assignee: Robert Bosch GmbH, Stuttgart, Fed. Rep. of Germany

[21] Appl. No.: 390,185

[22] Filed: Aug. 4, 1989

[30] Foreign Application Priority Data

Aug. 13, 1988 [DE] Fed. Rep. of Germany ..... 3827572

[51] Int. Cl.[5] ..... F02M 39/00

[52] U.S. Cl. ..... 123/510; 123/509; 123/514; 123/198 D; 137/113; 137/433

[58] Field of Search ..... 123/509, 510, 514, 198 D; 137/433, 113, 576, 574, 572, 628

[56] References Cited

U.S. PATENT DOCUMENTS

| | | | |
|---|---|---|---|
| 1,632,625 | 6/1927 | Jasser | 137/628 |
| 2,590,386 | 2/1952 | Dobrick | 137/433 |
| 2,998,056 | 8/1961 | Capehart | 137/113 |
| 4,672,937 | 6/1987 | Fales | 123/514 |
| 4,683,864 | 8/1987 | Bucci | 137/113 |
| 4,715,345 | 12/1987 | Reames | 137/433 |
| 4,724,860 | 2/1988 | Kelch | 137/433 |
| 4,776,315 | 10/1988 | Greiner | 123/510 |
| 4,807,582 | 2/1989 | Tuckey | 137/113 |
| 4,831,990 | 5/1989 | Tuckey | 123/510 |

*Primary Examiner*—Carl Stuart Miller

*Attorney, Agent, or Firm*—Michael J. Striker

[57] ABSTRACT

An arrangement for supplying fuel from a supply tank to an internal combustion engine of a power vehicle comprises a supply aggregate arranged to be located in a supply tank and a supply pump provided with a suction opening, a suction chamber having a first opening communicating with an interior of the tank and a second opening, a storage chamber supplied from fuel return conduit extending from the internal combustion engine and communicating with the suction chamber through the second opening, a blocking member arranged in the suction chamber and forming a valve with a limiting structure of the second opening, the valve closing the second opening until the suction opening formed in the suction chamber is immersed in fuel which flows from the tank into the suction chamber, the blocking member being arranged in a fuel suction stream and held from the latter on an abutment facing toward the suction chamber, whereby it releases the first opening, the blocking member in the event of an interruption in the fuel suction stream releases the second opening and blocks the first opening.

13 Claims, 2 Drawing Sheets

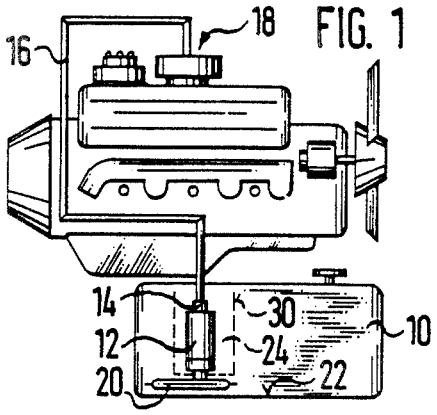
FIG. 1
FIG. 5
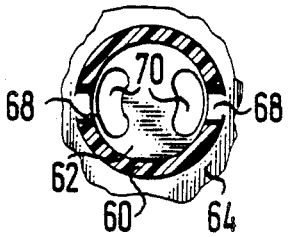
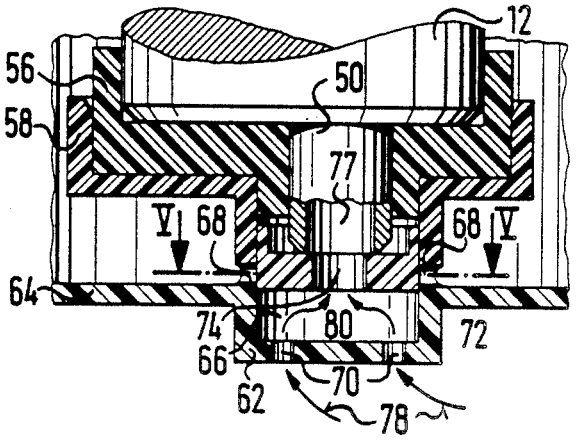
FIG. 3
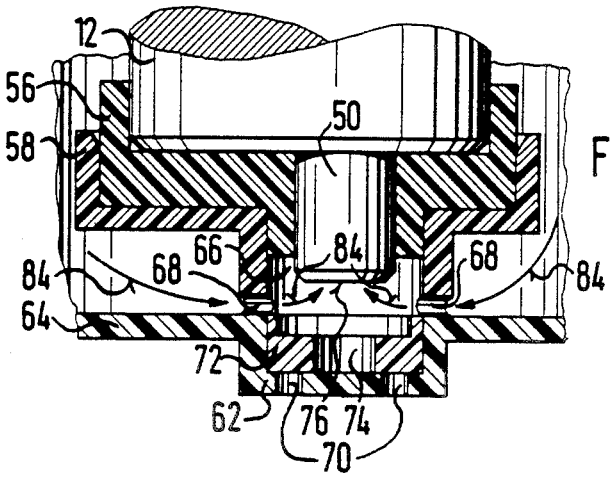
FIG. 4

ARRANGEMENT FOR SUPPLYING FUEL FROM A SUPPLY TANK TO INTERNAL COMBUSTION ENGINE OF POWER VEHICLE

BACKGROUND OF THE INVENTION

The present invention relates to an arrangement for supplying a fuel from a supply tank to an internal combustion engine of a power vehicle.

Arrangements of the above mentioned general type are known in the art. In a known arrangement a blocking member of a valve is arranged on a lever arm of two-armed lever. Another lever arm abuts against the inner side of a semi-permeable filter plate which limits a suction chamber relative to the inner chamber of the tank. The filter plate has throughgoing pores which form a first opening of the suction chamber to the inner chamber of the tank. When with a continuously emptying tank the power vehicle travels uphill or downhill, the residual fuel in the tank is located outside of the suction of the supply pump, so that the suction chamber is emptied fast. The thus produced increased negative pressure in the suction chamber pulls the filter plate inwardly, the lever is moved and the valve opened, so that a post-flow of the fuel from the storage chamber to the suction chamber can occur. This type of the valve actuation requires however a relatively high negative pressure which during normal operation of the supply aggregate can lead to an undesirably high cavitation. Furthermore, there is also the disadvantage that the suction chamber border formed as the filter place is permeable for the fuel, so that a part of the fuel available in the storage chamber can flow back into the inner chamber of the tank and during the time of the above-mentioned operational conditions of the power vehicle, the fuel supply aggregate is not available.

SUMMARY OF THE INVENTION

Accordingly, it is an object of the present invention to provide a fuel supply arrangement for supplying fuel from a supply tank to an internal combustion engine of a power vehicle, which avoids the disadvantages of the prior art.

More particularly it is an object of the present invention to provide an arrangement for supplying fuel of the above mentioned type which in operation of the arrangement and with a sufficiently filled supply tank aspirates the fuel to be supplied, and the fuel stream presses the blocking member against the abutment so that the first opening is released. Thus, the storage chamber is filled by the supply surplus flowing back through the fuel return conduit. When the fuel supply aggregate aspirates air for certain reasons while no fuel is available in the suction chamber, the blocking member arrives at its another operative position in which it releases the second opening, the fuel can flow from the storage chamber to the suction chamber and therefore insure the fuel supply to the internal combustion engine.

In keeping with these objects and with others which will become apparent hereinafter, one feature of the present invention resides, briefly stated, in an arrangement for supplying fuel from a supply tank to an internal combustion engine of a power vehicle comprises a supply aggregate arranged to be located in a supply tank and a supply pump provided with a suction opening, a suction chamber having a first opening communicating with an interior of the tank and a second opening, a storage chamber supplied from fuel return conduit extending from the internal combustion engine and communicating with the suction chamber through the second opening, a blocking member arranged in the suction chamber and forming a valve with a limiting structure of the second opening, the valve closing the second opening until the suction opening formed in the suction chamber is immersed in fuel which flows from the tank into the suction chamber, the blocking member being arranged in a fuel suction stream and held from the latter on an abutment facing toward the suction chamber, whereby it releases the first opening, the blocking member in the event of an interruption in the fuel suction stream releases the second opening and blocks the first opening.

In accordance with another feature of the present invention a guide is located adjacent to the suction opening, the blocking member being movable on the guide between two operative positions.

Still another feature of the present invention is that the blocking member is heavier than a quantity of the fuel corresponding to its volume.

A further feature of the present invention is that the storage chamber has a wall, the guide being formed as a cup-shaped cylinder which is connected with the wall, the cylinder having a cup bottom provided with the first opening and a wall provided with the second opening.

Each of the above-specified openings can be formed of several partial openings, in accordance with a further feature of the present invention.

Still a further feature of the present invention is that the cylinder has a cup inner wall, the blocking member being guided on the cup inner wall.

According to the present invention the cylinder has a cup part, a suction pipe is provided with the suction opening and extends through the cup, and an end surface surrounds the suction opening and forms the abutment for the blocking member located in its one operative position.

The cup bottom the cup bottom forms a displacement limit against which the blocking member abuts in its another operative position.

The blocking member the blocking member has a substantially pot-shaped cross-section with a pot bottom provided with a cutout which at least approximately coincides with the suction opening.

It is possible that the blocking member has a remaining pot bottom part which remains near the cutout and covers the first opening when the blocking member is in its other operative position.

In accordance with another feature of the present invention the cylinder has a cup edge provided with a receptacle for an end region of the fuel supply aggregate.

Still a further feature of the present invention is that an elastic dampening body is located between the fuel supply aggregate and the receptacle.

Finally, another feature of the present invention is that it further comprises a wall which limits the storage chamber and surrounds the fuel supply aggregate, the wall being provided with several holding means arranged at a distance from the receptacle and at a distance from one another in a peripheral direction, the holding means securing the fuel supply aggregate in its operative position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view schematically showing an arrangement for supplying a fuel in an internal combustion engine;

FIG. 3 is a view showing a fragment of FIG. 2 on an enlarged scale, with the fuel supply arranged in a normal operation;

FIG. 4 is a view showing the arrangement of FIG. 3 when the fuel supply aggregate is supplied from the storage chamber with fuel; and FIG. 5 is a partial section of the inventive arrangement taken in FIG. 4, without the blocking member.

DESCRIPTION OF THE PREFERRED EMBODIMENT

Figure 2:
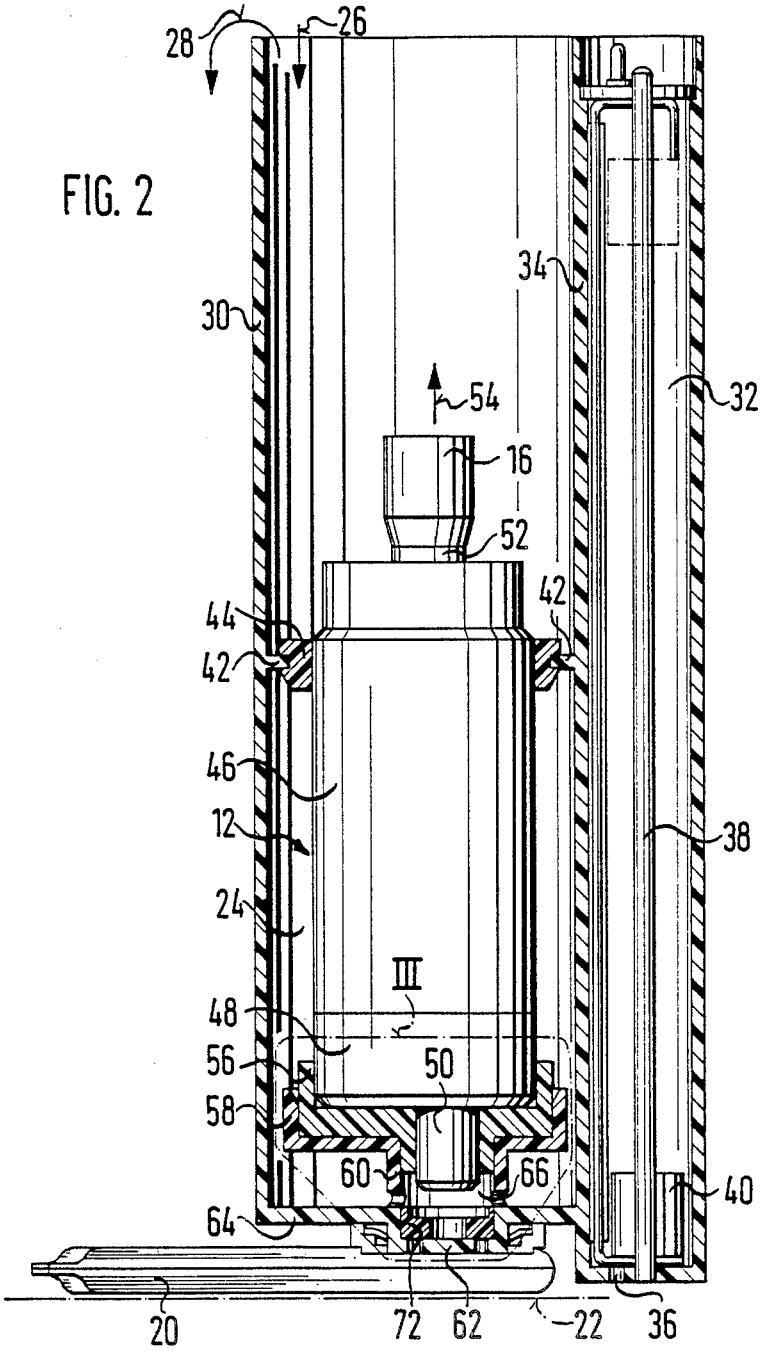
FIG. 2 is a view showing a section taken through a storage chamber arranged in a supply tank of the arrangement in accordance with the present invention with a fuel supply aggregate located in the storage chamber.

FIG. 1 shows a fuel supply tank 10 in which a fuel supply aggregate 12 is arranged. The fuel supply aggregate 12 has a pressure pipe 14 connected with a pressure conduit 16 which leads to an internal combustion engine 18. The internal combustion engine is a part of a not shown power vehicle. During the operation of the internal combustion engine, the fuel supply aggregate 12 supplies the fuel from the supply tank 10 to the internal combustion engine 18.

The fuel supply aggregate 12 has a not shown electric drive motor and a not shown suction-pressure pump driven by. The suction side of the fuel supply aggregate 12 is connected with a fuel filter 20 located near a bottom 22 of the supply tank 10. The fuel supply aggregate 12 is arranged in a storage chamber 24 which in turn is arranged in the fuel supply tank 20. Since the fuel supply aggregate 12 supplies more fuel than is required for the internal combustion engine, a not shown return conduit leads to the storage chamber 24 so that the latter is always filled with the fuel.

The excessive fuel flowing back into the storage chamber 24 is identified in FIG. 2 with an arrow 26. When the storage chamber 24 is filled with the fuel, the overflow which is identified in FIG. 2 with an arrow 28 flows into the fuel supply tank 10. The storage chamber 24 is closed by a cup-shaped structural member 30 having a partial chamber 32. The partial chamber 32 is separated from the storage chamber 24 by a partition 34.

The partial chamber 32 is conductively connected with the inner chamber of the tank through an opening 36 so that the fuel in the partial chamber 32 has a height substantially corresponding to the height in the supply tank 10. A float 40 arranged in it and guided on a rod 38 transfers the fuel level in a suitable manner to an indicating instrument arranged in the observation field of the power vehicle control handle or wheel 44. The fuel supply aggregate 12 is held in the cup-shaped container 30 by tongues 42 arranged on the container wall peripherally at a distance from one another. The fuel supply aggregate is supported on the tongues 42 through a damping ring 44.

The fuel supply aggregate 12 has a motor part 46 and a pump part 48. Both parts are jointly arranged in a common housing. Inside the common housing the motor part 46 is coupled with the pump part 48 so that the pump operates by activation of the drive motor. It aspirates fuel through a suction pipe 50 and displaces the same through the motor part 46 via a pressure pipe 52 to a pressure conduit 16 shown in FIG. 1. The fuel supplied through the pressure conduit 16 is identified in FIG. 2 with an arrow 54.

The storage chamber 24 which in normal operation is filled with fuel, is formed between the container wall 30 and the fuel supply aggregate 12. The fuel supply aggregate 12 is thereby completely immersed in the fuel.

The arrangement of the fuel supply aggregate is selected so that the fuel is supplied substantially in a vertical direction, and particularly from below upwardly. The lower end side of the roller-shaped supply aggregate 12 is supported in a shell-shaped receptacle 58 through a damping seal 56. The receptacle 58 is connected with the cup-shaped cylinder 60 at its cup end. The cup-shaped cylinder 60 is formed of one-piece integrally with the container 30 and extends with its cup bottom 62 in direction toward the tank bottom 22 outwardly beyond the container 30. The cup-shaped cylinder 60 extends thereby through the bottom 64 of the container 30. The receptacle 58 for the fuel supply aggregate 12 is located inside the container 30 in the storage chamber 24. Between the receptacle 58 and the inner side of the container wall a gap is produced so that the fuel can flow to the bottom 64 of the container.

The fuel supply aggregate 12 sits in dampened condition in the receptacle 58 and extends with its suction pipe 50 in the cup-shaped cylinder 60 so far that a suction chamber 66 remains. The suction chamber 66 is connected in the region of the container bottom 64 with the storage chamber 24 through two openings 68. Further, the bottom 62, the cup-shaped cylinder 60 has two cutouts 70 which open toward the filter 20. A pan-shaped blocking member 72 is located in the suction chamber 66. The arrangement of the blocking member is selected so that the pan bottom faces toward the bottom of the cup-shaped cylinder 60. The bottom of the blocking member 72 is interrupted. A cutout 74 in the pan bottom is arranged so that it approximately coincides with the suction opening 77 of the suction pipe 50. The arrangement of both cutouts 70, the bottom of the cup-shaped cylinder 60 is selected so that they are covered by the remaining portion of the pan bottom near the cutout 74, when the blocking member 72 abuts against the inner side of the bottom 62 of the cylinder cup 60.

The depth of the cylinder 60 is determined with respect to the suction pipe 50 of the fuel supply aggregate 12 so that the blocking member which is guided on the inner wall of the cylindrical cup 60 can move between two operative positions shown in FIGS. 3 and 4. In one operative position shown in FIG. 3 the blocking member 72 closes the openings 68 while the cutouts 70 are released, while in the operative position shown in FIG. 4 the openings 68 are released and the cutouts 70 are closed. The blocking member 72 is therefore bringable from one operative position in which it abuts against the bottom 62 of the cylinder cup 60 to a second operative position in which it abuts against an end surface 76 surrounding the suction opening 76 of the suction pipe 50. Finally, it should be mentioned that the blocking member 72 is somewhat heavier than the quantity of the fuel corresponding to its volume.

The fuel supply arrangement in accordance with the present invention operates in the following manner:

With the filled fuel tank 10, the operating pump aspirates the fuel from the suction chamber 66 in accordance with the arrow 78 and simultaneously pulls the blocking member 72 to its position shown in FIG. 3 in which it comes to abutment with its pot inner side against the end surface 77 of the suction pipe 50. In this operative position the blocking member 72 closes both openings 68 and releases both cutouts 70. The fuel to be supplied flows through the filter 20 in direction of the arrows 78 shown in FIG. 3, through the cutouts 70 into the suction chamber 66 and then in accordance with the arrows 80 further through the central opening 74 of the blocking member 72 into the suction opening 77 of the suction pipe 50 of the fuel supply aggregate 12. The blocking member 72 maintains this operative position as long as the fuel supply aggregate 12 can aspirate the fuel from the suction chamber 66 through the filter 20. During this time the container 30 is filled so that the storage chamber 24 is completely filled with the excessive fuel which flows back in direction of the arrows 26.

When however the fuel tank 10 is continuously emptied and the power vehicle in similar manner is parked on a slope it can happen that the fuel filter 20 is no longer located in the residual fuel. The same effect can occur also when the power vehicle with continuously emptying fuel supply tank 10 performs a fast curve travel, so that the residual fuel in the tank 10 is driven under the action of the fuel force toward its side. In both cases the supply of the internal combustion engine with fuel is no longer insured. Since in these operational conditions and also in normal operation available negative pressure in the suction chamber 66 is lifted, the blocking member 72 sinks downwardly to the operational position shown in FIG. 4. In this position it releases both openings 68 and closes both cutouts 70. Now the fuel located in the storage chamber 24 can flow through the openings 68 into the suction chamber 66 in accordance with the arrow 84, wherein the fuel supply aggregate 12 can aspirate this fuel and supply it to the internal combustion engine 18. The supply of the internal combustion engine 18 is insured for such a long time until the fuel is located in the storage chamber 24. The blocking member 72 is retained in its second operative position shown in FIG. 2, while the liquid column available in the storage chamber 24 holds the blocking member 72 in this operative position. Thus, the blocking member 72 is movable in two operative positions. In one operative position it closes both cutouts 70 and comes to abutment against the bottom surface 62 of the cylindrical cup. In its other operative position in which it abuts against a ring end surface of the suction pipe 50 surrounding the suction opening 76 of the supply pump, it closes both openings 68 and releases the cutouts 70.

It will be understood that each of the elements described above, or two or more together, may also find a useful application in other types of constructions differing from the types described above.

While the invention has been illustrated and described as embodied in an arrangement for supplying fuel from a supply tank to an internal combustion engine of a power vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for supplying fuel from a supply tank to an internal combustion engine of a power vehicle, comprising a supply aggregate arranged to be located in a supply tank and having a suction opening, a suction chamber having a first opening communicating with an interior of the tank and a second opening, a storage chamber supplied with a return fuel from the internal combustion engine and communicating with said suction chamber through said second opening, a blocking member arranged in said suction chamber and forming a valve with a limiting structure of said second opening, said valve closing said second opening until said suction opening is immersed in fuel which flows from said tank into said suction chamber, said blocking member being arranged in a fuel suction stream and held from the latter on an abutment facing toward said suction chamber, whereby it releases said first opening, said blocking member in the event of an interruption in the fuel suction stream releasing said second opening and blocking said first opening.

2. An arrangement as defined in claim 1; and further comprising a guide located adjacent to said suction opening, said blocking member being movable on said guide between two operative positions.

3. An arrangement as defined in claim 1, wherein said blocking member is heavier than a quantity of the fuel corresponding to its volume.

4. An arrangement as defined in claim 2, wherein said storage chamber has a wall, said guide being formed as a cup-shaped cylinder which is connected with said wall, said cylinder having a cup bottom provided with said first opening and a wall provided with said second opening.

5. An arrangement as defined in claim 1, wherein each of said openings is formed by a plurality of several partial openings.

6. An arrangement as defined in claim 4, wherein said cylinder has a cup inner wall, said blocking member being guided on said cup inner wall.

7. An arrangement as defined in claim 4, wherein said cylinder has a cup part; and further comprising a suction pipe provided with said suction opening and extending through said cup part, and an end surface which surrounds said suction opening and forms said abutment for said blocking member located in its one operative position.

8. An arrangement as defined in claim 7, wherein said cup bottom forms a displacement limit against which said blocking member abuts in its another operative position.

9. An arrangement as defined in claim 1, wherein said blocking member has a substantially pot-shaped cross-section with a pot bottom provided with a cutout which at least approximately coincides with said suction opening.

10. An arrangement as defined in claim 9, wherein said blocking member has a remaining pot bottom part which remains near said cutout and covers said first opening when said blocking member is in its other operative position.

11. An arrangement as defined in claim 4, wherein said cylinder has a cup edge provided with a receptacle for an end region of said fuel supply aggregate.

12. An arrangement as defined in claim 11; and further comprising an elastic dampening body located between said fuel supply aggregate and said receptacle.

13. An arrangement as defined in claim 13; and further comprising a wall which limits said storage chamber and surrounds said fuel supply aggregate, said wall being provided with several holding means arranged at a distance from said receptacle and at a distance form one another in a peripheral direction, said holding means securing said fuel supply aggregate in its operative position.

* * * * *